US012422143B1

(12) United States Patent
Boardman

(10) Patent No.: US 12,422,143 B1
(45) Date of Patent: Sep. 23, 2025

(54) FUEL-AIR MIXER FOR TURBINE ENGINE COMBUSTION SECTION

(71) Applicant: RTX Corporation, Farmington, CT (US)

(72) Inventor: Gregory Boardman, Owens Cross Roads, AL (US)

(73) Assignee: RTX Corporation, Farmington, CT (US)

( * ) Notice: Subject to any disclaimer, the term of this patent is extended or adjusted under 35 U.S.C. 154(b) by 0 days.

(21) Appl. No.: 18/596,056

(22) Filed: Mar. 5, 2024

(51) Int. Cl.
*F23R 3/28* (2006.01)
*F23R 3/14* (2006.01)

(52) U.S. Cl.
CPC ..... *F23R 3/286* (2013.01); *F23R 3/14* (2013.01)

(58) Field of Classification Search
CPC ..... F23R 3/14; F23R 3/286
See application file for complete search history.

(56) References Cited

U.S. PATENT DOCUMENTS

| | | | | |
|---|---|---|---|---|
| 4,955,191 | A | 9/1990 | Okamoto | |
| 5,054,279 | A | 10/1991 | Hines | |
| 5,220,795 | A | 6/1993 | Dodds et al. | |
| 5,303,542 | A | 4/1994 | Hoffa | |
| 5,307,634 | A | 5/1994 | Hu | |
| 5,423,173 | A | 6/1995 | Lemon | |
| 5,813,232 | A | 9/1998 | Razdan | |
| 7,536,862 | B2 | 5/2009 | Held | |
| 8,312,724 | B2 | 11/2012 | Dai | |
| 8,789,372 | B2 | 7/2014 | Johnson | |
| 9,482,433 | B2 | 11/2016 | Lee | |
| 10,054,312 | B2 | 8/2018 | Dai | |
| 10,267,524 | B2 | 4/2019 | Lee | |
| 10,823,416 | B2 | 11/2020 | Patel | |
| 11,668,462 | B1 | 6/2023 | Benjamin | |
| 2007/0044477 | A1 | 3/2007 | Held | |
| 2007/0289305 | A1* | 12/2007 | Oda | F23R 3/286 60/748 |
| 2009/0111063 | A1 | 4/2009 | Boardman | |
| 2010/0180603 | A1 | 7/2010 | Simmons | |
| 2011/0271682 | A1 | 11/2011 | Sandelis | |

(Continued)

OTHER PUBLICATIONS

EP Search Report for EP Patent Application No. 25150257.1 dated Apr. 22, 2025.

*Primary Examiner* — David P. Olynick
(74) *Attorney, Agent, or Firm* — Getz Balich LLC

(57) ABSTRACT

An apparatus is provided for a turbine engine. This apparatus includes a fuel-air mixer, and the fuel-air mixer includes a mixer outlet, an annular inner passage, an air swirler, an annular fuel passage and a fuel swirler. The annular inner passage extends axially along an axis within the fuel-air mixer. The annular inner passage includes an inner passage downstream section and an inner passage upstream section fluidly coupled with the mixer outlet through the inner passage downstream section. The inner passage downstream section radially tapers and diverges radially outward away from the axis as the annular inner passage extends axially towards the mixer outlet. The air swirler is disposed with the inner passage upstream section. The annular fuel passage circumscribes the annular inner passage and extends axially within the fuel-air mixer to the inner passage downstream section. The fuel swirler is disposed with the annular fuel passage.

19 Claims, 9 Drawing Sheets

(56) References Cited

U.S. PATENT DOCUMENTS

| | | | | |
|---|---|---|---|---|
| 2012/0151930 | A1 | 6/2012 | Patel | |
| 2012/0228397 | A1* | 9/2012 | Thomson | F23D 11/107 239/553 |
| 2013/0074504 | A1 | 3/2013 | Baruah | |
| 2014/0041390 | A1 | 2/2014 | Williams | |
| 2014/0360202 | A1 | 12/2014 | Toon | |
| 2016/0245522 | A1 | 8/2016 | Dai | |
| 2016/0290649 | A1* | 10/2016 | Prociw | F23R 3/14 |
| 2016/0313007 | A1* | 10/2016 | Martini | F23R 3/283 |
| 2017/0159937 | A1 | 6/2017 | Kobayashi | |
| 2018/0094590 | A1* | 4/2018 | Proscia | F23R 3/12 |
| 2019/0264913 | A1 | 8/2019 | Johansson | |
| 2020/0025386 | A1* | 1/2020 | Muldal | F23R 3/343 |
| 2022/0397274 | A1 | 12/2022 | Itoh | |
| 2023/0104395 | A1 | 4/2023 | Pradeep | |
| 2023/0194094 | A1 | 6/2023 | Han | |

* cited by examiner

FUEL-AIR MIXER FOR TURBINE ENGINE COMBUSTION SECTION

GOVERNMENT LICENSE RIGHTS

This invention was made with Government support under Contract DE-FE0032171 awarded by the United States Department of Energy. The Government has certain rights in this invention.

BACKGROUND OF THE DISCLOSURE

1. Technical Field

This disclosure relates generally to a turbine engine and, more particularly, to a fuel-air mixer for the turbine engine.

2. Background Information

As government emissions standards tighten, interest in alternative fuels for gas turbine engines continues to grow. There is interest, for example, in fueling a gas turbine engine with hydrogen ($H_2$) fuel rather than a traditional hydrocarbon fuel such as kerosine to reduce greenhouse emissions. While known hydrogen combustion systems have various advantages, there is still room in the art for improvement.

SUMMARY OF THE DISCLOSURE

According to an aspect of the present disclosure, an apparatus is provided for a turbine engine. This apparatus includes a fuel-air mixer, and the fuel-air mixer includes a mixer outlet, an annular inner passage, an air swirler, an annular fuel passage and a fuel swirler. The annular inner passage extends axially along an axis within the fuel-air mixer. The annular inner passage includes an inner passage downstream section and an inner passage upstream section fluidly coupled with the mixer outlet through the inner passage downstream section. The inner passage downstream section radially tapers and diverges radially outward away from the axis as the annular inner passage extends axially towards the mixer outlet. The air swirler is disposed with the inner passage upstream section. The annular fuel passage circumscribes the annular inner passage and extends axially within the fuel-air mixer to the inner passage downstream section. The fuel swirler is disposed with the annular fuel passage.

According to another aspect of the present disclosure, another apparatus is provided for a turbine engine. This apparatus includes a fuel-air mixer, and the fuel-air mixer includes an annular first passage, an annular inner passage, an annular outer passage and an annular fuel passage. The annular inner passage extends axially along an axis within the fuel-air mixer to the annular first passage. The annular inner passage diverges radially outward away from the axis as the annular inner passage extends axially to the annular first passage. The annular outer passage extends axially along the axis within the fuel-air mixer to the annular first passage. The annular outer passage circumscribes the annular inner passage and the annular fuel passage. The annular outer passage converges radially inward towards the axis as the annular outer passage extends axially to the annular first passage. The annular fuel passage is radially between the annular inner passage and the annular outer passage. The annular fuel passage circumscribes the annular inner passage. The annular fuel passage extends axially along the axis within the fuel-air mixer to an annular outlet from the annular fuel passage into the annular inner passage.

According to still another aspect of the present disclosure, another apparatus is provided for a turbine engine. This apparatus includes a fuel-air mixer, and the fuel-air mixer includes a mixer outlet, an annular inner passage, an annular fuel passage and a resonator. The annular inner passage extends axially along an axis within the fuel-air mixer and circumscribes the resonator. The annular inner passage includes an inner passage downstream section and an inner passage upstream section fluidly coupled with the mixer outlet through the inner passage downstream section. The inner passage downstream section diverges radially outward away from the axis as the annular inner passage extends axially towards the mixer outlet. The annular fuel passage circumscribes the annular inner passage and extends axially within the fuel-air mixer to the inner passage downstream section. The resonator forms an inner peripheral boundary of the annular inner passage. The resonator includes an air inlet, a plurality of air outlets and an internal cavity fluidly coupled with and between the air inlet and the air outlets. The internal cavity fluidly coupled with the mixer outlet through the air outlets.

A cross-sectional area of the inner passage downstream section may decrease as the annular inner passage extends axially towards the mixer outlet.

A centerline of a half of the inner passage upstream section may be parallel with the axis. A centerline of a half of the inner passage downstream section may be angularly offset from the axis by an acute angle.

A centerline of a half of the annular fuel passage may be angularly offset from a centerline of a half of the inner passage downstream section by an acute angle.

A centerline of a half of the annular fuel passage at an annular outlet from the annular fuel passage into the inner passage downstream section may be parallel with the axis.

The air swirler may be configured to swirl air flowing within the annular inner passage towards the mixer outlet in a first circumferential direction about the axis. The fuel swirler may be configured to swirl fuel flowing within the annular fuel passage towards the inner passage downstream section in the first circumferential direction about the axis.

The fuel-air mixer may also include an annular outer passage circumscribing the annular inner passage and the annular fuel passage. The annular outer passage may extend axially along the axis within the fuel-air mixer and is fluidly coupled with the mixer outlet.

The annular outer passage may converge radially inward towards the axis as the annular outer passage extends axially towards the mixer outlet.

The fuel-air mixer may also include a plurality of non-swirling struts arranged circumferentially about the axis and extending radially across the annular outer passage.

The air swirler may be an inner air swirler. The fuel-air mixer may also include an outer air swirler disposed with the annular outer passage.

The fuel-air mixer may also include a center body with the annular inner passage extending axially along and circumscribing the center body. The center body may include an air inlet, a plurality of air outlets and an internal cavity fluidly coupled with and between the air inlet and the air outlets. The internal cavity may be fluidly coupled with the mixer outlet through the air outlets.

The center body may form an inner peripheral boundary of the annular inner passage.

A cross-sectional area of the air inlet may be greater than a cross-sectional area of each of the air outlets. The cross-sectional area of the air inlet may be less than a total cross-sectional area of the air outlets.

The internal cavity may include a cavity upstream section and a cavity downstream section between the cavity upstream section and the air outlets. The cavity downstream section may radially expand as the internal cavity extends axially within the center body towards the air outlets.

The apparatus may also include an annular combustor bulkhead extending circumferentially around an axial centerline. The fuel-air mixer may be one of a plurality of fuel-air mixers mounted to the annular combustor bulkhead. A first of the fuel-air mixers may be located radially outboard of a second of the fuel-air mixers.

The first of the fuel-air mixers may be circumferentially aligned with the second of the fuel-air mixers.

The apparatus may also include a pilot fuel injector. The fuel-air mixer may be one of a plurality of fuel-air mixers arranged in an array symmetrically about the pilot fuel injector.

The apparatus may also include a pilot fuel injector. The fuel-air mixer may be one of a plurality of fuel-air mixers arranged in an array asymmetrically about the pilot fuel injector.

The present disclosure may include any one or more of the individual features disclosed above and/or below alone or in any combination thereof.

The foregoing features and the operation of the invention will become more apparent in light of the following description and the accompanying drawings.

DETAILED DESCRIPTION

Figure 1:
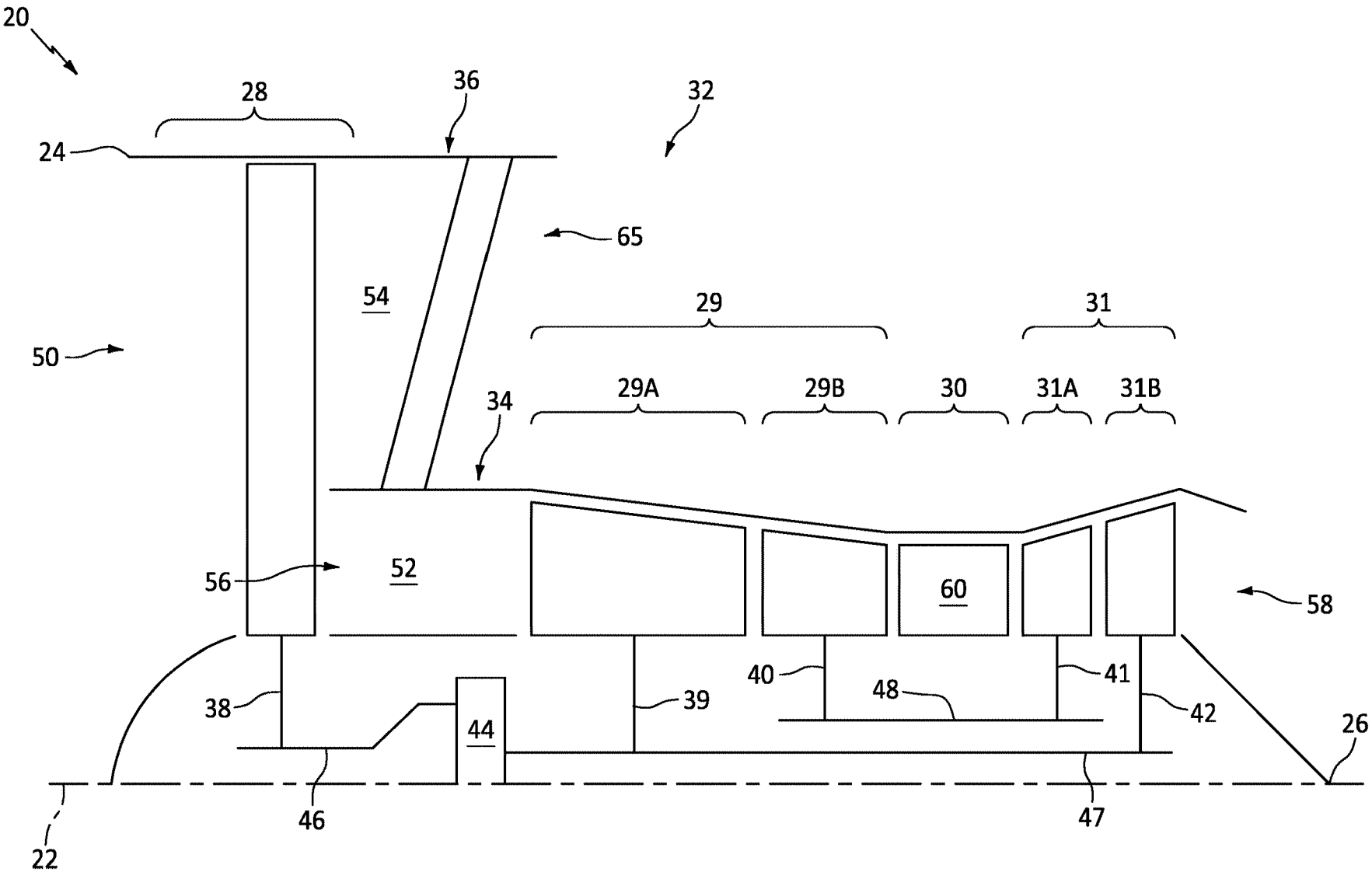
FIG. 1 is a partial schematic illustration of a gas turbine engine.

FIG. 1 illustrates a gas turbine engine 20 for an aircraft. The aircraft may be an airplane, a drone (e.g., an unmanned aerial vehicle (UAV)) or any other manned or unmanned aerial vehicle or system. The turbine engine 20 of FIG. 1 is configured as, or may be part of, a propulsion system for the aircraft. The turbine engine 20, however, may also or alternatively be configured as, or may be part of, an electrical power system for the aircraft. The turbine engine 20 of the present disclosure, however, is not limited to aircraft applications. The turbine engine 20, for example, may alternatively be configured as an industrial turbine engine.

The turbine engine 20 of FIG. 1 extends axially along an axial centerline 22 between a forward, upstream end 24 of the turbine engine 20 and an aft, downstream end 26 of the turbine engine 20. The turbine engine 20 includes a fan section 28, a compressor section 29, a combustor section 30 and a turbine section 31. The compressor section 29 of FIG. 1 includes a low pressure compressor (LPC) section 29A and a high pressure compressor (HPC) section 29B. The turbine section 31 of FIG. 1 includes a high pressure turbine (HPT) section 31A and a low pressure turbine (LPT) section 31B.

The engine sections 28-31B of FIG. 1 are arranged sequentially along the axial centerline 22 within an engine housing 32. This engine housing 32 includes an inner case 34 (e.g., a core case) and an outer case 36 (e.g., a fan case). The inner case 34 may house one or more of the engine sections 29A-31B; e.g., a core of the turbine engine 20. The outer case 36 may house at least the fan section 28.

Each of the engine sections 28, 29A, 29B, 31A and 31B includes a respective bladed rotor 38-42. Each of these bladed rotors 38-42 includes a plurality of rotor blades arranged circumferentially around and connected to one or more respective rotor disks and/or hubs. The rotor blades, for example, may be formed integral with or mechanically fastened, welded, brazed and/or otherwise attached to the respective rotor disk(s) and/or the respective hub(s).

The fan rotor 38 is connected to a geartrain 44, for example, through a fan shaft 46. The geartrain 44 and the LPC rotor 39 are connected to and driven by the LPT rotor 42 through a low speed shaft 47. The HPC rotor 40 is connected to and driven by the HPT rotor 41 through a high speed shaft 48. The engine shafts 46-48 are rotatably supported by a plurality of bearings; e.g., rolling element and/or thrust bearings. Each of these bearings is connected to the engine housing 32 by at least one stationary structure such as, for example, an annular support strut.

During engine operation, air enters the turbine engine 20 through an airflow inlet 50 into the turbine engine 20. This air is directed through the fan section 28 and into a (e.g., annular) core flowpath 52 and a (e.g., annular) bypass flowpath 54. The core flowpath 52 extends sequentially through the engine sections 29A-31B (e.g., the engine core) from an inlet 56 into the core flowpath 52 to an exhaust 58 from the core flowpath 52. The air within the core flowpath 52 may be referred to as "core air". The bypass flowpath 54 extends through a bypass duct, and bypasses (e.g., extends axially along and outside of) the engine core. The air within the bypass flowpath 54 may be referred to as "bypass air".

The core air is compressed by the LPC rotor 39 and the HPC rotor 40 and directed into a (e.g., annular) combustion chamber 60 within the combustor section 30. Fuel is injected into the combustion chamber 60 and mixed with the compressed core air to provide a fuel-air mixture. This fuel-air mixture is ignited and combustion products thereof flow through and sequentially cause the HPT rotor 41 and the LPT rotor 42 to rotate before being directed out of the turbine engine 20 through the core exhaust 58. The rotation of the HPT rotor 41 and the LPT rotor 42 respectively drive rotation of the HPC rotor 40 and the LPC rotor 39 and, thus, compression of the air received from the core inlet 56. The rotation of the LPT rotor 42 also drives rotation of the fan rotor 38, which propels the bypass air through the bypass flowpath 54 and out of the turbine engine 20 through an exhaust 65 from the bypass flowpath 54. The propulsion of the bypass air may account for a majority of thrust generated by the turbine engine 20.

Figure 2:
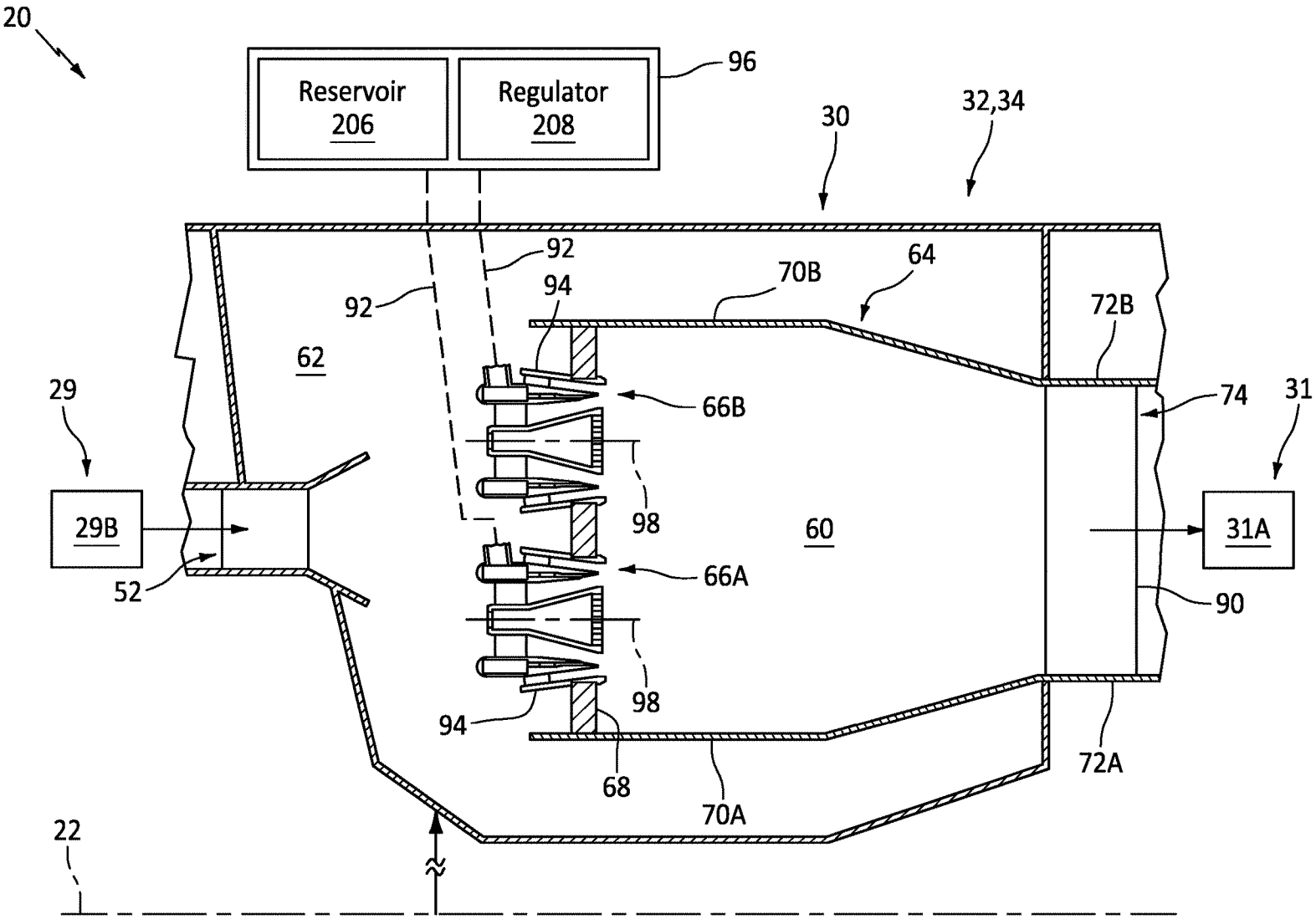
FIG. 2 is a partial schematic illustration of a combustor section between a compressor section and a turbine section.

FIG. 2 illustrates a portion of the combustor section 30 along the core flowpath 52 between the HPC section 29B and the HPT section 31A. This combustor section 30 includes a diffuser plenum 62, a combustor 64 and one or more fuel-air mixers 66A and 66B (generally referred to as "66"); see also FIG. 3. Briefly, the combustor 64 and the fuel-air mixers 66 are disposed within (e.g., surrounded by) the diffuser plenum 62. The diffuser plenum 62 is configured to receive compressed core air from the HPC section 29B for subsequent provision into the combustion chamber 60, for example, substantially through the fuel-air mixers 66.

The combustor 64 may be configured as an annular combustor; e.g., an annular floating wall combustor. The combustor 64 of FIGS. 2 and 3, for example, includes an annular combustor bulkhead wall 68 ("bulkhead"), a tubular inner combustor wall 70A ("inner wall") and a tubular outer combustor wall 70B ("outer wall"). The bulkhead 68 of FIG. 2 extends radially between and to the inner wall 70A and the outer wall 70B. The bulkhead 68 may be connected (e.g., mechanically fastened or otherwise attached) to the inner wall 70A and/or the outer wall 70B. Each combustor wall 70A, 70B (generally referred to as "70") projects axially along the axial centerline 22 out from the bulkhead 68 towards the HPT section 31A. The inner wall 70A of FIG. 2, for example, projects axially to and may be connected to an inner platform 72A of a downstream stator vane array 74; e.g., a turbine inlet nozzle in the HPT section 31A. The outer wall 70B of FIG. 2 projects axially to and may be connected to an outer platform 72B of the stator vane array 74. With the arrangement of FIG. 2, the combustion chamber 60 is formed by and extends radially within the combustor 64 between and to the inner wall 70A and the outer wall 70B. The combustion chamber 60 is formed by and extends axially (in an upstream direction along the core flowpath 52) into the combustor 64 from the stator vane array 74 to the bulkhead 68. The combustion chamber 60 also extends within the combustor 64 circumferentially about (e.g., completely around) the axial centerline 22.

Figure 4:
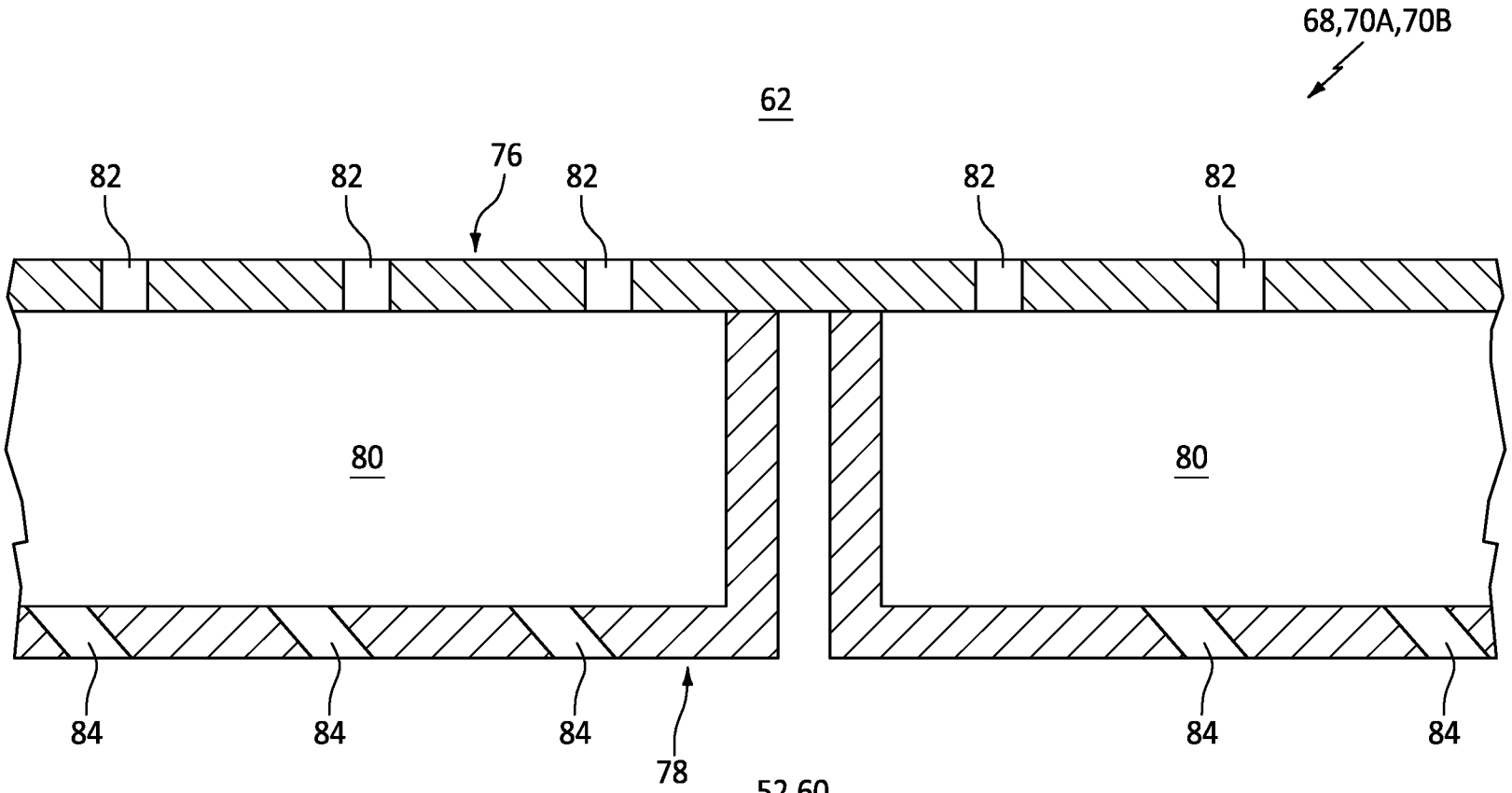
FIG. 4 is a partial sectional illustration of a combustor wall.
Figure 5:
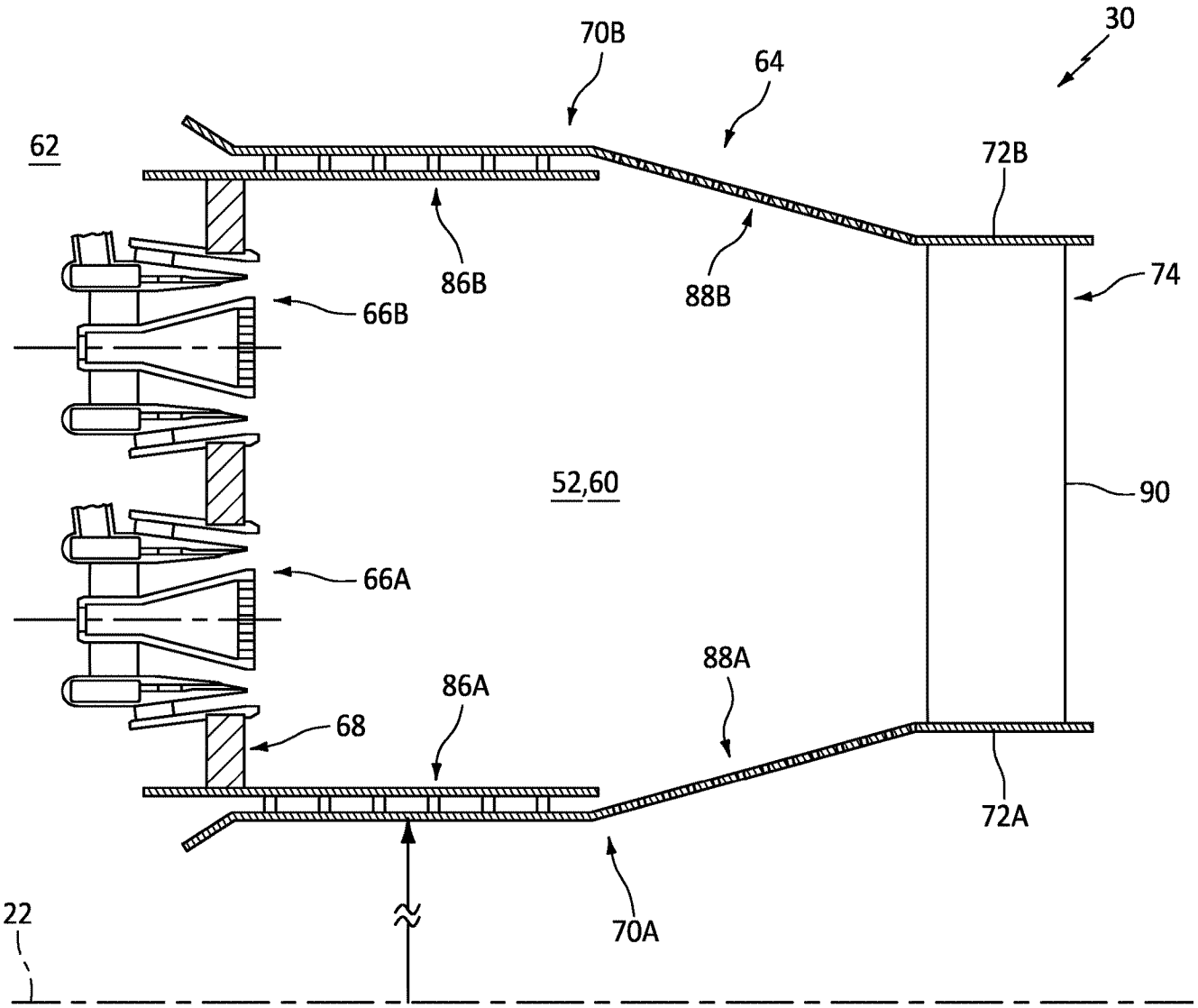
FIG. 5 is a partial schematic illustration of another combustor with the fuel-air mixers.

Referring to FIG. 4, any one or more or all of the combustor walls 68, 70A, 70B may each be configured as a multi-walled structure; e.g., a hollow, dual-walled structure. For example, each combustor walls 68, 70A, 70B of FIG. 4 includes a combustor wall shell 76, a combustor wall heat shield 78 (e.g., a liner) and one or more combustor wall cooling cavities 80 (e.g., impingement cavities) formed by and (e.g., radially and/or axially) between the shell 76 and the heat shield 78. Each cooling cavity 80 of FIG. 4 is fluidly coupled with the diffuser plenum 62 through one or more cooling apertures 82 in the shell 76; e.g., impingement apertures. Each cooling cavity 80 of FIG. 4 is fluidly coupled with the combustion chamber 60 through one or more cooling apertures 84 in the heat shield 78; e.g., effusion apertures. Of course, various other multi-walled combustor wall structures are known in the art, and the present disclosure is not limited to any particular ones thereof. Furthermore, it is contemplated any one or more of the combustor walls 68, 70A, 70B of FIG. 2 may alternatively be configured as a single-walled structure. The shell 76 (see FIG. 4) for example, may be omitted and the heat shield 78 may form a single walled liner/wall. Referring to FIG. 5, it is also contemplated any one or more of the combustor walls 68, 70A, 70B may alternatively be configured as a hybrid between a multi-walled structure and a single walled structure. Each combustor wall 70A, 70B of FIG. 5, for example, includes an upstream section 86A, 86B and a downstream section 88A, 88B, where the upstream section 86A, 86B is configured as a multi-walled structure and the downstream section 88A, 88B is configured as a single walled structure.

Referring to FIG. 2, the stator vane array 74 includes the inner platform 72A, the outer platform 72B and a plurality of stator vanes 90 (one visible in FIG. 2). The stator vanes 90 are arranged circumferentially about the axial centerline 22 in an array; e.g., a circular array. Each of these stator vanes 90 extends radially across the core flowpath 52 between and to the inner platform 72A and the outer platform 72B. Each of the stator vanes 90 may also be connected to the inner platform 72A and/or the outer platform 72B. The stator vane array 74 and its stator vanes 90 are configured to turn and/or otherwise condition the combustion products exiting the combustion chamber 60 for interaction with a first stage of the HPT rotor 41; see FIG. 1.

Figure 3:
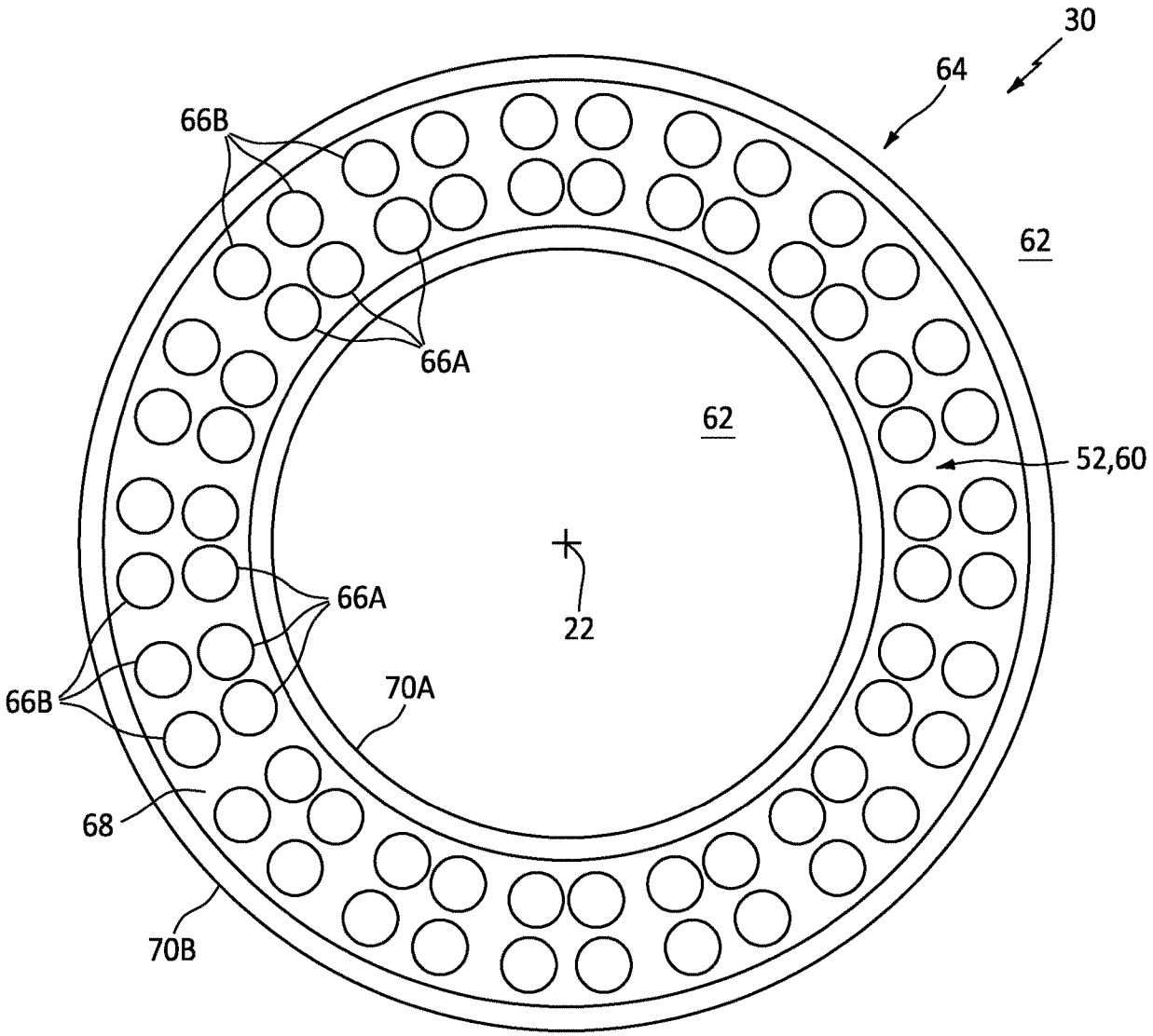
FIG. 3 is a schematic end view illustration of a combustor with multiple fuel-air mixers.

Referring to FIG. 3, the fuel-air mixers 66 may be divided into one or more sets of the fuel-air mixers 66. The inner fuel-air mixers 66A in the inner set are arranged circumferentially about the axial centerline 22 in an inner mixer array; e.g., a circular array. The outer fuel-air mixers 66B in the outer set are arranged circumferentially about the axial centerline 22 in an outer mixer array; e.g., a circular array. Within each array, the fuel-air mixers 66 may be equally spaced about the axial centerline 22 by a common (e.g., the same) circumferential inter-mixer distance. Each outer fuel-air mixer 66B is circumferentially aligned with a respective one of the inner fuel-air mixers 66A. Each inner fuel-air mixer 66A of FIG. 3 is similarly circumferentially aligned with a respective one of the outer fuel-air mixers 66B. The present disclosure, however, is not limited to such an exemplary fuel-air mixer arrangement. For example, one or more of the outer fuel-air mixers 66B may be circumferentially offset from the circumferentially closest inner fuel-air mixer 66A and/or one or more of the inner fuel-air mixers 66A may be circumferentially offset from the circumferentially closest outer fuel-air mixer 66B. In another example, the fuel-air mixers 66 within each array may be arranged into a plurality of groupings; e.g., pairs. The groupings may be spaced circumferentially about the axial centerline 22 by a common first circumferential inter-grouping distance. The fuel-air mixers 66 within each grouping may be spaced about the axial centerline 22 by a common circumferential intra-grouping distance that is different (e.g., less) than the inter-grouping distance.

Figure 6:
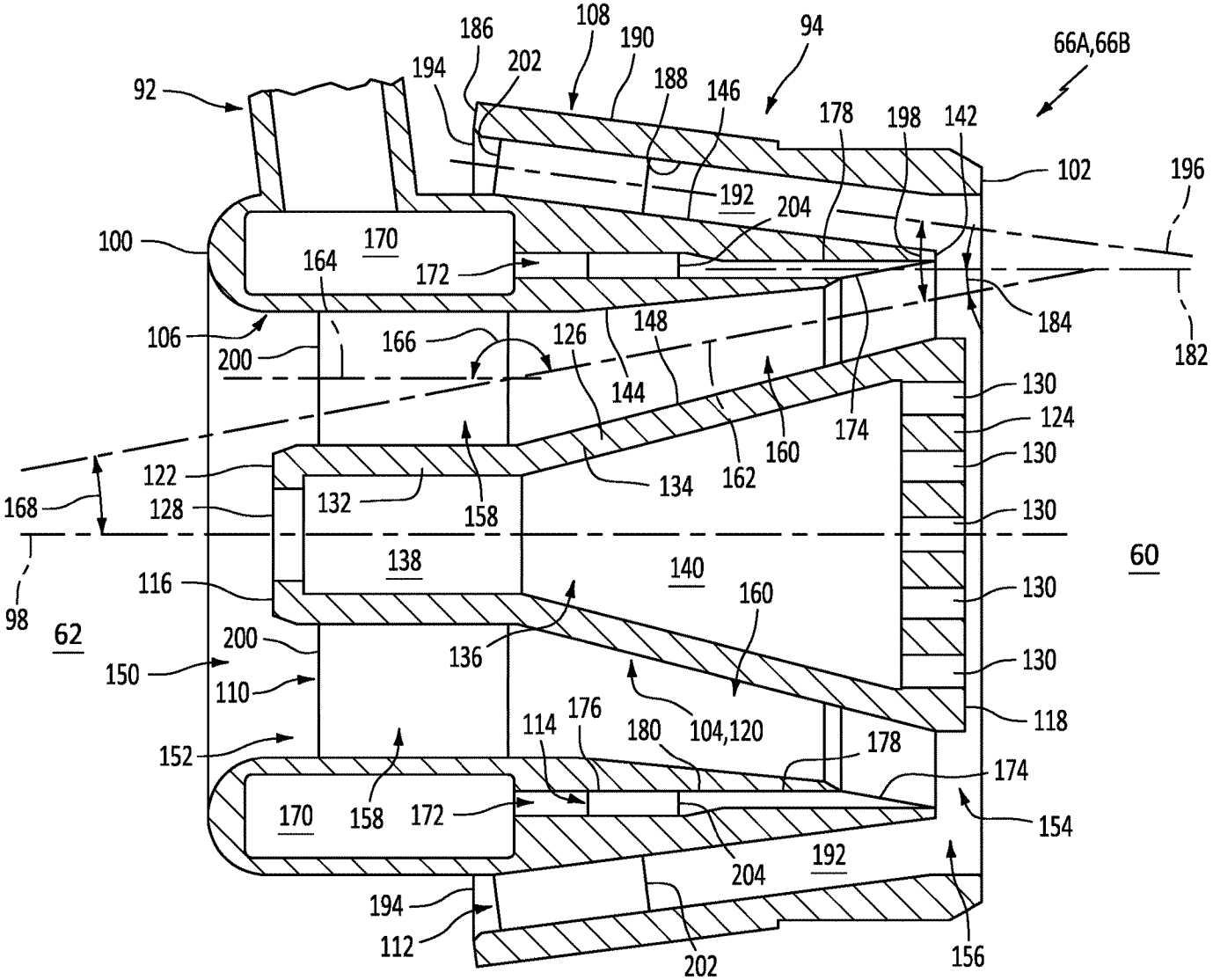
FIG. 6 is a partial sectional illustration of one of the fuel-air mixers.

Referring to FIG. 2, each fuel-air mixer 66 includes a fuel conduit 92 and a tubular mixer body 94. The fuel conduit 92 is configured to route the fuel received from a fuel source 96 to the mixer body 94. Referring to FIG. 6, the fuel conduit 92 is connected to and may be cantilevered from the mixer body 94. The mixer body 94 of FIG. 6 extends axially along a centerline axis 98 of the mixer body 94 from an upstream end 100 of the respective fuel-air mixer 66 and its mixer body 94 to a downstream end 102 of the respective fuel-air mixer 66 and its mixer body 94. The mixer body 94 projects radially out to an outer side of the mixer body 94. The mixer body 94 of FIG. 6 includes a mixer center body 104, a mixer fuel injector body 106 and a mixer shroud 108. The mixer body 94 of FIG. 6 also includes an inner air swirler 110, an outer air swirler 112 and a fuel swirler 114.

The mixer center body 104 extends axially along the centerline axis 98 from an upstream end 116 of the mixer center body 104 to a downstream end 118 of the mixer center body 104. The center body upstream end 116 may be axially recessed from the mixer upstream end 100. The center body downstream end 118 may be axially recessed from the mixer downstream end 102. The mixer center body 104 may be configured as a sound resonator 120; e.g., a sound attenuator, a sound muffler, etc. The mixer center body 104 of FIG. 6, for example, includes a center body upstream endwall 122, a center body downstream endwall 124 and a tubular center body sidewall 126.

The upstream endwall 122 is disposed at the center body upstream end 116. The upstream endwall 122 projects radially to the center body sidewall 126. The upstream endwall 122 includes a single air inlet 128 which projects axially through the upstream endwall 122. The air inlet 128 of FIG. 6 is coaxial with the centerline axis 98. The air inlet 128 has a cross-sectional area when viewed, for example, in a reference plane perpendicular to the centerline axis 98. Of course, in other embodiments, it is contemplated the upstream endwall 122 may alternatively include multiple of the air inlets.

Figure 7:
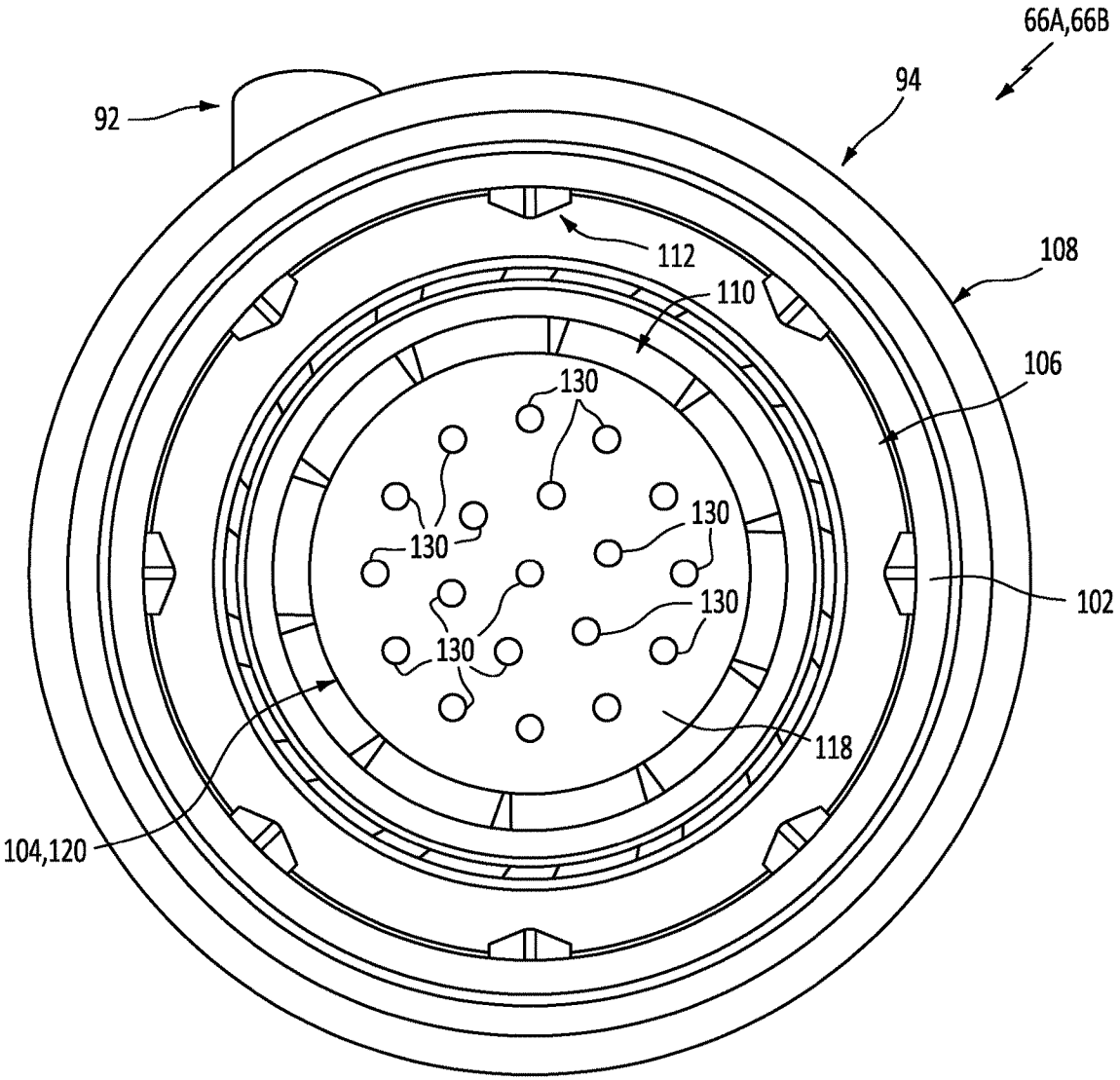
FIG. 7 is an end view illustration of one of the fuel-air mixers.

The downstream endwall 124 is disposed at the center body downstream end 118. The downstream endwall 124 projects radially to the center body sidewall 126. The downstream endwall 124 includes one or more air outlets 130 which project axially through the downstream endwall 124. Referring to FIG. 7, these air outlets 130 may be arranged in one or more concentric arrays or otherwise distributed in, for example, a showerhead pattern. Referring again to FIG. 6, each of the air outlets 130 has a (e.g., common) cross-sectional area when viewed, for example, in a reference plane perpendicular to the centerline axis 98. This air outlet cross-sectional area is sized smaller than the air inlet cross-sectional area. However, a total of the air outlet cross-sectional areas (a total air outlet cross-sectional area) may be sized greater than the air inlet cross-sectional area. The total air outlet cross-sectional area, for example, may be two times (2×), three times (3×), four times (4×) or more than the air inlet cross-sectional area. Note, where the mixer center body 104 includes multiple of the air inlets, the total air outlet cross-sectional area may be two times (2×), three times (3×), four times (4×) or more than a total of the air inlet cross-sectional areas (a total air inlet cross-sectional area).

The center body sidewall 126 extends axially between and is connected to the upstream endwall 122 and the downstream endwall 124. The center body sidewall 126 of FIG. 6 includes a sidewall upstream section 132 and a sidewall downstream section 134. The sidewall upstream section 132 projects axially along the centerline axis 98 between the upstream endwall 122 and the sidewall downstream section 134. This sidewall upstream section 132 may have a cylindrical geometry. A radius from the centerline axis 98 to the center body sidewall 126, for example, may be uniform (e.g., constant) as the sidewall upstream section 132 extends axially along the centerline axis 98 from the upstream endwall 122 to the sidewall downstream section 134. The sidewall downstream section 134 projects axially along the centerline axis 98 between the downstream endwall 124 and the sidewall upstream section 132. This sidewall downstream section 134 may have a frustoconical geometry. The radius from the centerline axis 98 to the center body sidewall 126, for example, may change (e.g., continuously or incrementally increase) as the sidewall downstream section 134 extends axially along the centerline axis 98 from the sidewall upstream section 132 to the downstream endwall 124.

The center body elements 122, 124 and 126 of FIG. 6 collectively form an internal cavity 136 (e.g., a resonance chamber) within the mixer center body 104. This center body cavity 136 extends axially within the mixer center body 104 along the centerline axis 98 from the upstream endwall 122 to the downstream endwall 124. The center body cavity 136 thereby fluidly couples the air inlet 128 to the air outlets 130. The center body cavity 136 also projects radially within the mixer center body 104 from the centerline axis 98 to the center body sidewall 126. An upstream section 138 of the center body cavity 136 extends axially along the sidewall upstream section 132 and may have a cylindrical geometry. A downstream section 140 of the center body cavity 136 extends axially along the sidewall downstream section 134 and may have a frustoconical geometry. The cavity downstream section 140 of FIG. 6, for example, radially expands as the center body cavity 136 extends axially from the cavity upstream section 138 to (or about) the downstream endwall 124 and its air outlets 130.

The fuel injector body 106 extends axially along the centerline axis 98 from the mixer upstream end 100 to a downstream end 142 of the fuel injector body 106. The injector body downstream end 142 may be axially recessed from the mixer downstream end 102. The injector body downstream end 142 may also be axially recessed from the center body downstream end 118. The fuel injector body 106 extends radially from a radial inner side 144 of the fuel injector body 106 to a radial outer side 146 of the fuel injector body 106. The injector body inner side 144 is spaced radially outward from a radial outer side 148 of the mixer center body 104 and its center body sidewall 126. The fuel injector body 106 extends circumferentially about (e.g., completely around) the centerline axis 98. With this arrangement, the fuel injector body 106 axially overlaps and circumscribes the mixer center body 104.

The fuel injector body 106 forms a mixer inlet 150 (e.g., an airflow inlet) within the respective fuel-air mixer 66 and its mixer body 94. This mixer inlet 150 projects axially along the centerline axis 98 into the respective fuel-air mixer 66 and its mixer body 94 from the mixer upstream end 100 to the mixer center body 104 and its upstream endwall 122. The mixer inlet 150 thereby fluidly couples the diffuser plenum 62 to the air inlet 128. The mixer inlet 150 also fluidly couples the diffuser plenum 62 to an annular inner passage 152 within the respective fuel-air mixer 66 and its mixer body 94.

The inner passage 152 extends axially along the centerline axis 98 within the respective fuel-air mixer 66 and its mixer body 94 from the mixer inlet 150 towards a mixer outlet 154 from the respective fuel-air mixer 66 and its mixer body 94 into the combustion chamber 60. The inner passage 152 of FIG. 6, for example, extends axially along the mixer center body 104 and the fuel injector body 106 from the mixer inlet 150 to an annular intermediate passage 156. A radial inner peripheral boundary of the inner passage 152 is formed by the mixer center body 104 at its center body outer side 148. A radial outer peripheral boundary of the inner passage 152 is formed by the fuel injector body 106 at its injector body inner side 144.

An upstream section 158 of the inner passage 152 extends axially along the sidewall upstream section 132 and may have an annular cylindrical geometry. For example, the inner passage 152 has a cross-sectional area when viewed, for example, in a reference plane perpendicular to the centerline axis 98. This inner passage cross-sectional area may remain uniform as the inner passage upstream section 158 extends axially from the mixer inlet 150 to a downstream section 160 of the inner passage 152.

The inner passage downstream section 160 extends axially along the sidewall downstream section 134 and may have an annular frustoconical geometry. The inner passage cross-sectional area, for example, may change (e.g., decrease) as the inner passage downstream section 160 extends axially from the inner passage upstream section 158 to (or about) the intermediate passage 156. In addition or alternatively, an inner radius and/or an outer radius of the inner passage downstream section 160 may change (e.g., increase) as the inner passage downstream section 160 extends axially from the inner passage upstream section 158 to (or about) the intermediate passage 156. The inner passage 152 and, more particularly, its downstream section 160 may thereby radially taper and/or diverge radially outward away from the centerline axis 98 as the inner passage 152 and its downstream section 160 extend axially towards the mixer outlet 154; e.g., to the intermediate passage 156. The inner passage upstream section 158 therefore has a cross-sectional area that is greater than (e.g., between 1.05 to 1.20 times greater than) a cross-sectional area of the inner passage downstream section 160 (e.g., adjacent the intermediate passage 156).

A centerline 162 of a (e.g., top or bottom radial) half of the inner passage downstream section 160 of FIG. 6 is angularly offset from a centerline 164 of a corresponding (e.g., top or bottom radial) half of the inner passage upstream section 158 by an included obtuse angle 166 when viewed, for example, in a reference plane parallel with (e.g., including) the centerline axis 98. This obtuse angle 166 is less than one-hundred and eighty degrees (<180°) and may be equal to or greater than one-hundred and thirty-five degrees (≥180°). The downstream section centerline 162 of FIG. 6 is also angularly offset from the centerline axis 98 by an included (e.g., non-zero) acute angle 168. This acute angle 168 is greater than zero degrees (>0°) and may be equal to or less than forty-five degrees (≤45°). The upstream section centerline 164 of FIG. 6 is parallel with the centerline axis 98; however, the present disclosure is not limited thereto.

The fuel injector body 106 includes an internal fuel plenum 170 and an internal annular fuel passage 172. The fuel plenum 170 fluidly couples the fuel conduit 92 to the fuel passage 172. The fuel plenum 170 may axially overlap the mixer inlet 150 and/or the inner passage upstream section 158. The fuel plenum 170 may also circumscribe the mixer inlet 150 and/or the inner passage upstream section 158. The fuel passage 172 extends axially within the fuel injector body 106 from the fuel plenum 170 to an annular outlet 174 from the fuel passage 172 into the inner passage 152. This fuel passage outlet 174 is formed in a canted (e.g., frustoconical) surface of the fuel injector body 106 along the injector body inner side 144. The fuel passage outlet 174 of FIG. 6 is disposed axially at (e.g., on, adjacent or proximate) the injector body downstream end 142.

The fuel passage 172 of FIG. 6 includes an upstream section 176, a downstream section 178 and an intermediate section 180. The fuel passage upstream section 176 extends axially from the fuel plenum 170 to the fuel passage intermediate section 180. This fuel passage upstream section 176 may have a uniform cross-sectional area along its longitudinal length; e.g., axial length. The fuel passage downstream section 178 extends axially from the fuel passage intermediate section 180 to the fuel passage outlet 174. This fuel passage downstream section 178 may have a uniform cross-sectional area along its longitudinal length; e.g., axial length. The fuel passage intermediate section 180 extends axially between and to the fuel passage upstream section 176 and the fuel passage downstream section 178. This fuel passage intermediate section 180 may radially taper inwards such that the cross-sectional area of the fuel passage downstream section 178 is less than the cross-sectional area of the fuel passage upstream section 176. However, in other embodiments, it is contemplated the fuel passage 172 may alternatively have a uniform cross-sectional area from the fuel plenum 170 to the fuel passage outlet 174.

A centerline 182 of a (e.g., top or bottom radial) half of the fuel passage 172 of FIG. 6 and its downstream section 178 is arranged parallel with the centerline axis 98 when viewed, for example, in a reference plane parallel with (e.g., including) the centerline axis 98; however, the present disclosure is not limited thereto. The fuel passage centerline 182 of FIG. 6 is also angularly offset from the downstream section centerline 162 by an included (e.g., non-zero) acute angle 184. This acute angle 184 is greater than zero degrees (>0°) and may be equal to or less than thirty degrees (≤30°).

The mixer shroud 108 extends axially along the centerline axis 98 from an upstream end 186 of the mixer shroud 108 to the mixer downstream end 102. The shroud upstream end 186 is axially spaced from the mixer upstream end 100. The mixer shroud 108 extends radially from a radial inner side 188 of the mixer shroud 108 to a radial outer side 190 of the mixer shroud 108. The shroud inner side 188 is spaced radially outward from injector body outer side 146. The mixer shroud 108 extends circumferentially about (e.g., completely around) the centerline axis 98. With this arrangement, the mixer shroud 108 axially overlaps and circumscribes the fuel injector body 106 as well as the mixer center body 104.

The mixer shroud 108 forms the mixer outlet 154 within the respective fuel-air mixer 66 and its mixer body 94. This mixer outlet 154 projects axially along the centerline axis 98 into the respective fuel-air mixer 66 and its mixer body 94 from the mixer downstream end 102 to the mixer center body 104 and its downstream endwall 124. The mixer outlet 154 thereby fluidly couples the combustion chamber 60 to the air outlets 130. The mixer outlet 154 also fluidly couples the combustion chamber 60 to the intermediate passage 156.

The intermediate passage 156 extends axially along the centerline axis 98 within the respective fuel-air mixer 66 and its mixer body 94 from the mixer outlet 154 to the inner passage 152. The intermediate passage 156 also extends axially along the centerline axis 98 within the respective fuel-air mixer 66 and its mixer body 94 from the mixer outlet 154 to an annular outer passage 192 within the respective fuel-air mixer 66 and its mixer body 94. With the arrangement of FIG. 6, the inner passage 152 and the outer passage 192 are fluidly coupled to the intermediate passage 156 in parallel. A radial inner peripheral boundary of the intermediate passage 156 is formed by the mixer center body 104 at its center body outer side 148. A radial outer peripheral boundary of the intermediate passage 156 is formed by the mixer shroud 108 at its shroud inner side 188. Of course, in other embodiments, the intermediate passage 156 may be omitted and the inner passage 152 and the outer passage 192 may be fluidly coupled to the mixer outlet 154 in parallel.

The outer passage 192 extends axially along the centerline axis 98 within the respective fuel-air mixer 66 and its mixer body 94 from an annular inlet orifice 194 towards the mixer outlet 154. The outer passage 192 of FIG. 6, for example, extends axially along the fuel injector body 106 and the mixer shroud 108 from the inlet orifice 194 to the intermediate passage 156. A radial inner peripheral boundary of the outer passage 192 is formed by the fuel injector body 106 at its injector body outer side 146. A radial outer peripheral boundary of the outer passage 192 is formed by the mixer shroud 108 at its shroud inner side 188. With this arrangement, the fuel injector body 106 may form an annular splitter for directing the compressed core air in the diffuser plenum 62 into the inner passage 152 and the outer passage 192.

The outer passage 192 may have an annular frustoconical geometry. For example, the outer passage 192 has a cross-sectional area when viewed, for example, in a reference plane perpendicular to the centerline axis 98. This outer passage cross-sectional area may change (e.g., decrease) as the outer passage 192 extends axially from (or about) the inlet orifice 194 to (or about) the intermediate passage 156. In addition or alternatively, an inner radius and/or an outer radius of the outer passage 192 may change (e.g., decrease) as the outer passage 192 extends axially from (or about) the inlet orifice 194 to (or about) the intermediate passage 156. The outer passage 192 may thereby converge radially inward towards the centerline axis 98 as the outer passage 192 extends axially towards the mixer outlet 154; e.g., to the intermediate passage 156.

A centerline 196 of a (e.g., top or bottom radial) half of the outer passage 192 of FIG. 6 is angularly offset from the centerline axis 98 by an included (e.g., non-zero) acute angle. This acute angle is greater than zero degrees (>0°) and may be equal to or less than forty-five degrees (≤45°). The outer passage centerline 196 of FIG. 6 is also angularly offset from the downstream section centerline 162 by an include (e.g., non-zero) acute angle 198. This acute angle 198 is greater than zero degrees (>0°) and may be equal to or less than forty-five degrees (≤45°); e.g., between ten degrees (10°) and thirty degrees (30°).

The inner air swirler 110 may be configured as an axial air swirler. The inner air swirler 110 of FIG. 6, for example, includes a plurality of inner swirler vanes 200 arranged circumferentially about the centerline axis 98 in an inner vane array. This inner vane array and its inner swirler vanes 200 are arranged within the inner passage 152 and, more particularly, the inner passage upstream section 158. Each of the inner swirler vanes 200 projects radially across the inner passage 152 and its inner passage upstream section 158 from the mixer center body 104 to the fuel injector body 106. The inner air swirler 110 and its inner swirler vanes 200 are configured to swirl fluid (e.g., the compressed core air) flowing thereacross in a first circumferential direction (e.g., clockwise or counterclockwise) about the centerline axis 98.

The outer air swirler 112 may be configured as an axial air swirler. The outer air swirler 112 of FIG. 6, for example, includes a plurality of outer swirler vanes 202 arranged circumferentially about the centerline axis 98 in an outer vane array. This outer vane array and its outer swirler vanes 202 are arranged within the outer passage 192, for example at or near the inlet orifice 194. Each of the outer swirler vanes 202 projects radially across the outer passage 192 from the fuel injector body 106 to the mixer shroud 108. The outer air swirler 112 and its outer swirler vanes 202 are configured to swirl fluid (e.g., the compressed core air) flowing thereacross in the first circumferential direction (e.g., clockwise or counterclockwise) about the centerline axis 98, or alternatively in a second circumferential direction (e.g., counterclockwise or clockwise) about the centerline axis 98 opposite of the first circumferential direction. However, in general, a degree of swirl induced by the outer air swirler 112 is less than a degree of swirl induced by the inner air swirler 110. To this point, it is contemplated the outer swirler vanes 202 may be replaced with a plurality of non-swirling struts; e.g., struts with mean lines which run longitudinally parallel with the centerline axis 98. Thus, the outer air swirler 112 may be replaced by a non-swirling vane array.

The fuel swirler 114 may be configured as an axial fuel swirler. The fuel swirler 114 of FIG. 6, for example, includes a plurality of fuel swirler vanes 204 arranged circumferentially about the centerline axis 98 in a fuel swirler vane array. This fuel swirler vane array and its fuel swirler vanes 204 are arranged within the fuel passage 172 and, more particularly, the fuel passage upstream section 176. Each of the fuel swirler vanes 204 projects radially across the fuel passage 172 and its fuel passage upstream section 176. The fuel swirler 114 and its fuel swirler vanes 204 are configured to swirl fluid (e.g., the fuel) flowing thereacross in the first circumferential direction (e.g., clockwise or counterclockwise) about the centerline axis 98. In general, a degree of swirl induced by the fuel swirler 114 is similar to the degree of swirl induced by the inner air swirler 110.

Referring to FIG. 2, each fuel-air mixer 66 is mated with the combustor 64. More particularly, each fuel-air mixer 66 and its mixer body 94 are mated with the bulkhead 68. The mixer body 94 of FIG. 2, for example, projects axially along its centerline axis 98 through (or partially into) an aperture in the bulkhead 68. Each fuel-air mixer 66 and its mixer body 94 may be attached to the combustor 64 and its bulkhead 68 using various techniques; e.g., bonding, mechanical fastening, etc. Each fuel-air mixer 66 and its mixer body 94 may thereby be fixedly attached to the bulkhead 68. However, in other embodiments, each fuel-air mixer 66 may be moveably attached to the bulkhead 68 through, for example, a sliding guide plate.

During operation of the combustor section 30 of FIG. 2, each fuel-air mixer 66 receives the fuel from the fuel source 96 and the compressed core air from the diffuser plenum 62. At each fuel-air mixer 66 of FIG. 6, the fuel injector body 106 injects a swirled annular fuel flow out of the fuel passage 172 and into the inner passage 152. This annular fuel flow is subsequently directed through the intermediate passage 156 and the mixer outlet 154 into the combustion chamber 60. A radial inner periphery of the annular fuel flow is shrouded by a swirled annular inner airflow, and a radial outer periphery of the annular fuel flow is shrouded by a swirled (or non-swirled) annular outer airflow. These annular airflows flow along the annular fuel flow through the intermediate passage 156 and the mixer outlet 154 into the combustion chamber 60 which may facilitate deeper penetration of the fuel into the combustion chamber 60 before mixing with the compressed air and igniting. However, the swirling of the fuel and the air from the inner passage 152 may also facilitate mixing of the fuel and the air after penetration into the combustion chamber 60.

The combustion of the fuel-air mixture within the combustion chamber 60 generates noise. At least some frequencies of this combustion noise (e.g., frequencies equal to or above 700 Hz or 1000 Hz) may be attenuated by each sound resonator 120. For example, noise waves generated by the combustion process may travel into the center body cavity 136 through the air outlets 130. These noise waves may be captured and muffled within the respective sound resonator 120. Note, an acoustic impedance and/or damping effectiveness of each sound resonator 120 may be tuned by selectively tailoring a size (e.g., diameter) of the air outlets 130 and/or a quantity of the air outlets 130; e.g., a porosity of the respective downstream endwall 124.

The fuel source 96 of FIG. 2 includes a fuel reservoir 206 and/or a fuel flow regulator 208; e.g., a valve and/or a pump. The fuel reservoir 206 is configured to store the fuel before, during and/or after turbine engine operation. The fuel reservoir 206, for example, may be configured as or otherwise include a tank, a cylinder, a pressure vessel, a bladder or any other type of fuel storage container. The fuel flow regulator 208 is configured to direct and/or meter a flow of the fuel from the fuel reservoir 206 to one or more or all of the fuel-air mixers 66.

The fuel delivered by the fuel source 96 may be a non-hydrocarbon fuel; e.g., a hydrocarbon free fuel. An example of the non-hydrocarbon fuel is hydrogen fuel; e.g., hydrogen ($H_2$) gas. The turbine engine 20 of FIG. 1 may thereby be configured as a non-hydrocarbon turbine engine; e.g., a hydrocarbon free turbine engine. The present disclosure, however, is not limited to non-hydrocarbon turbine engines. The fuel delivered by the fuel source 96, for example, may alternatively be a hydrocarbon fuel such as, but not limited to, kerosene or jet fuel. The turbine engine 20 of FIG. 1 may thereby be configured as a hydrocarbon turbine engine. Alternatively, the fuel source 96 may be configured as a multi-fuel system operable to deliver, individually or in combination, multiple different fuels (e.g., a non-hydrocarbon fuel and a hydrocarbon fuel, etc.) for combustion within the combustion chamber 60. The turbine engine 20 of FIG. 1 may thereby be configured as a multi-fuel turbine engine; e.g., a dual-fuel turbine engine. However, for ease of description, the fuel delivered by the fuel source 96 may be described as the non-hydrocarbon fuel; e.g., the hydrogen fuel.

In some embodiments, referring to FIG. 6, each fuel-air mixer 66 or at least its mixer body 94 may be formed as a monolithic body. The term "monolithic" may describe a body which is cast, machined, additively manufactured and/or otherwise formed as a single, integral unit. By contrast, a non-monolithic body includes multiple bodies which are separately formed and then mechanically fastened and/or otherwise attached to one another after the formation of those bodies. Of course, in other embodiments, it is contemplated one or more elements (e.g., 104, 106, 108, 110, 112 and/or 114) of each fuel-air mixer 66 or its mixer body 94 may be discretely formed and then attached to one another. The present disclosure therefore is not limited to such an exemplary monolithic configuration.

Figure 8B:
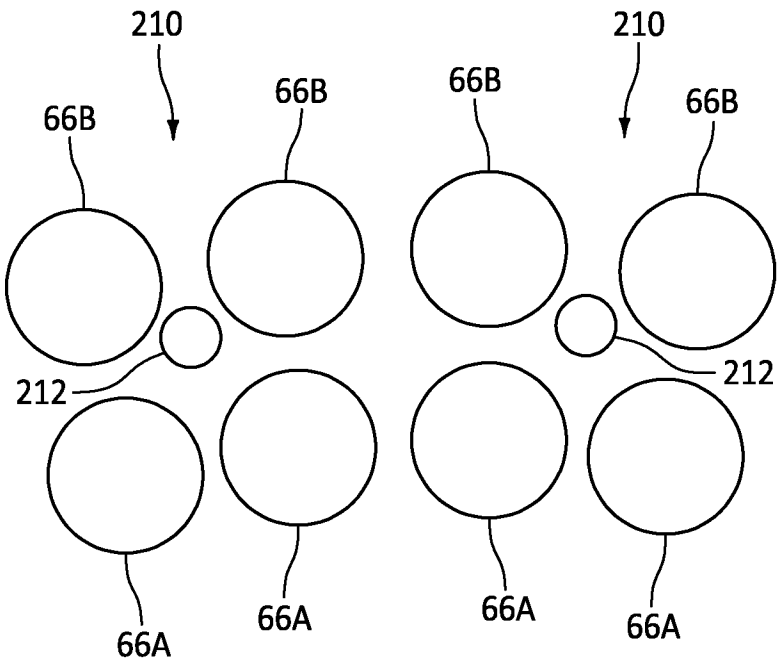
FIGS. 8A and 8B are partial schematic illustrations of the fuel-air mixers in various arrangements with pilot fuel injectors.
Figure 8A:
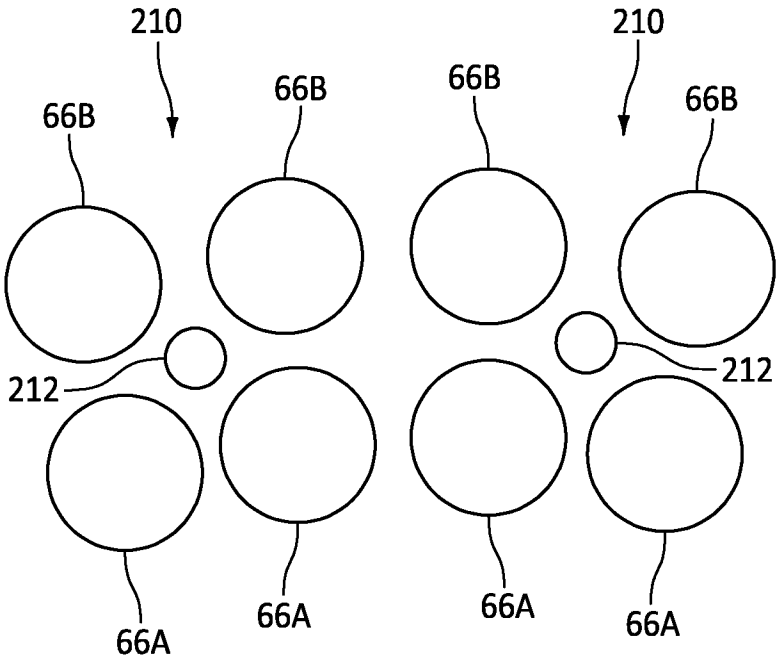

In some embodiments, referring to FIGS. 8A and 8B, the inner fuel-air mixers 66A and the outer fuel-air mixers 66B may be arranged into one or more clusters 210; e.g., local arrays and/or matrices. Each cluster 210 of FIGS. 8A and 8B, for example, includes a respective pair of the inner fuel-air mixers 66A and a (e.g., corresponding circumferentially aligned) respective pair of the outer fuel-air mixers 66B. One or more of these clusters 210 may also be associated with a respective pilot fuel injector 212. The fuel-air mixers 66 in each cluster of FIGS. 8A and 8B, for example, are arranged in an array about the respective pilot fuel injector 212. In some embodiments, referring to FIG. 8A, the array of the fuel-air mixers 66 in the respective cluster 210 may be symmetrical; e.g., a symmetric array. In other embodiments, referring to FIG. 8B, the array of the fuel-air mixers 66 in the respective cluster 210 may be asymmetrical; e.g., an asymmetrical array.

Figure 9:
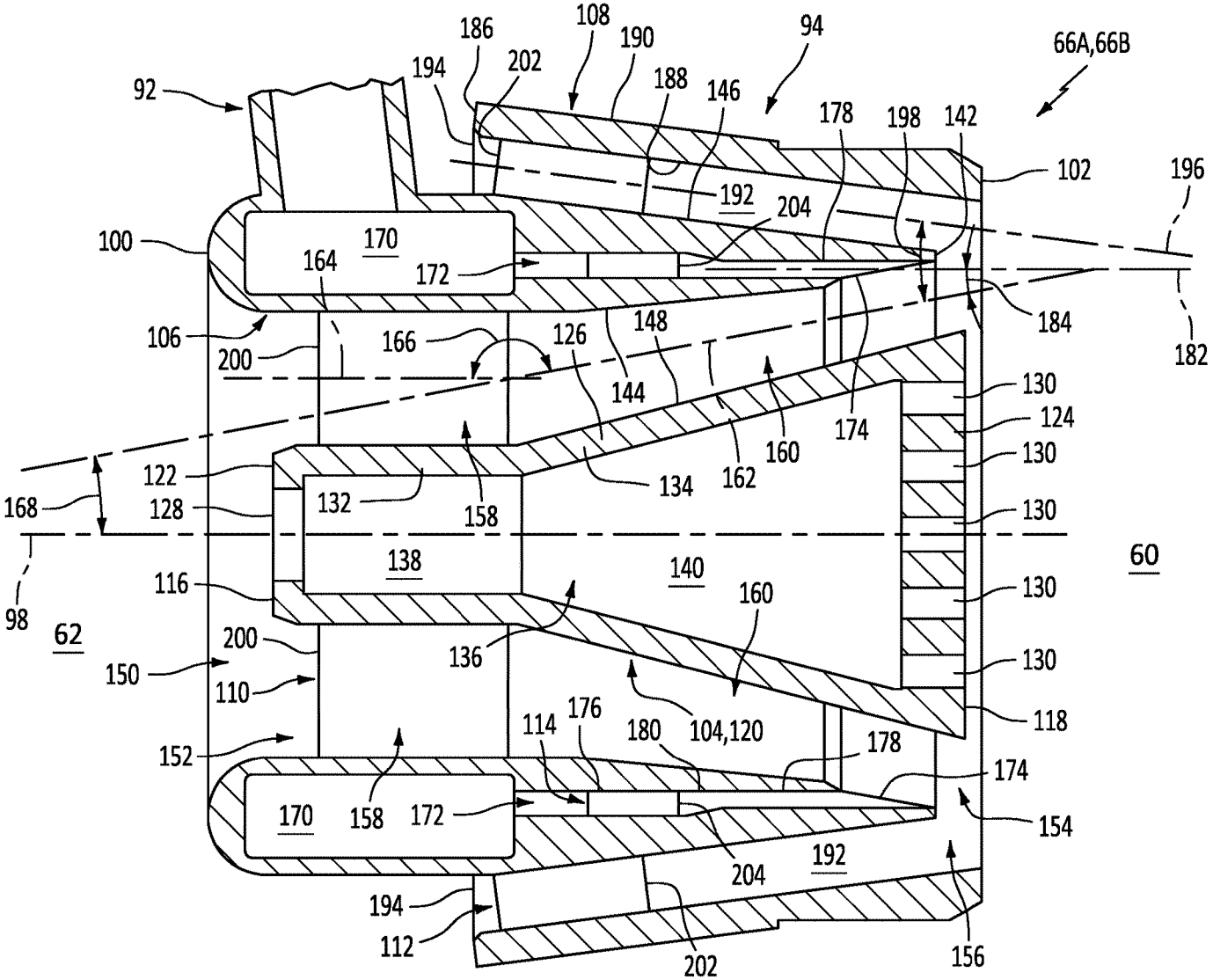
FIG. 9 is a partial sectional illustration of another fuel-air mixer.

In some embodiments, referring to FIG. 6, a downstream, radial inner corner of the mixer shroud 108 may be eased; e.g., chamfered. A downstream, radial outer corner of the fuel injector body 106 may also or alternatively be eased; e.g., chamfered. In other embodiments, referring to FIG. 9, the downstream, radial inner corner of the mixer shroud 108 may be sharp; e.g., pointed, not-chamfered, etc. The downstream, radial outer corner of the fuel injector body 106 may also or alternatively be sharp; e.g., pointed, not-chamfered, etc.

The fuel-air mixer(s) 66 may be included in various turbine engines other than the one described above. The fuel-air mixer(s) 66, for example, may be included in a geared turbine engine where a geartrain connects one or more shafts to one or more rotors in a fan section, a compressor section and/or any other engine section. Alternatively, the fuel-air mixer(s) 66 may be included in a turbine engine configured without a geartrain; e.g., a direct drive turbine engine. The fuel-air mixer(s) 66 may be included in a geared or non-geared turbine engine configured with a single spool, with two spools (e.g., see FIG. 1), or with more than two spools. The turbine engine may be configured as a turbofan engine, a turbojet engine, a turboprop engine, a turboshaft engine, a propfan engine, a pusher fan engine or any other type of turbine engine. The turbine engine may alternatively be configured as an auxiliary power unit (APU) or an industrial gas turbine engine. The present disclosure therefore is not limited to any particular types or configurations of turbine engines.

While various embodiments of the present disclosure have been described, it will be apparent to those of ordinary skill in the art that many more embodiments and implementations are possible within the scope of the disclosure. For example, the present disclosure as described herein includes several aspects and embodiments that include particular features. Although these features may be described individually, it is within the scope of the present disclosure that some or all of these features may be combined with any one of the aspects and remain within the scope of the disclosure. Accordingly, the present disclosure is not to be restricted except in light of the attached claims and their equivalents.

What is claimed is:

1. An apparatus for a turbine engine, comprising:

a fuel-air mixer including a mixer outlet, an annular inner passage, an air swirler, an annular fuel passage, a center body and a fuel swirler;

the annular inner passage extending axially along an axis within the fuel-air mixer, the annular inner passage extending axially along and circumscribing the center body, the annular inner passage including an inner passage downstream section and an inner passage upstream section fluidly coupled with the mixer outlet through the inner passage downstream section, and the inner passage downstream section radially tapering and diverging radially outward away from the axis as the annular inner passage extends axially towards the mixer outlet;

the air swirler disposed with the inner passage upstream section;

the annular fuel passage circumscribing the annular inner passage and extending axially within the fuel-air mixer to the inner passage downstream section, wherein a centerline of a half of the annular fuel passage, at an annular outlet from the annular fuel passage into the inner passage downstream section, is parallel with the axis;

the center body including an air inlet, a plurality of air outlets and an internal cavity, the internal cavity fluidly coupled with and between the air inlet and the plurality of air outlets, the internal cavity fluidly coupled with the mixer outlet through the plurality of air outlets, and the internal cavity extending within the axis; and the fuel swirler disposed with the annular fuel passage.

2. The apparatus of claim 1, wherein a cross-sectional area of the inner passage downstream section decreases as the annular inner passage extends axially towards the mixer outlet.

3. The apparatus of claim 1, wherein a centerline of a half of the inner passage upstream section is parallel with the axis; and a centerline of a half of the inner passage downstream section is angularly offset from the axis by an acute angle.

4. The apparatus of claim 1, wherein the centerline of the half of the annular fuel passage is angularly offset from a centerline of a half of the inner passage downstream section by an acute angle.

5. The apparatus of claim 1, wherein the air swirler is configured to swirl air flowing within the annular inner passage towards the mixer outlet in a first circumferential direction about the axis; and the fuel swirler is configured to swirl fuel flowing within the annular fuel passage towards the inner passage downstream section in the first circumferential direction about the axis.

6. The apparatus of claim 1, wherein the fuel-air mixer further includes an annular outer passage circumscribing the annular inner passage and the annular fuel passage; and the annular outer passage extends axially along the axis within the fuel-air mixer and is fluidly coupled with the mixer outlet.

7. The apparatus of claim 6, wherein the annular outer passage converges radially inward towards the axis as the annular outer passage extends axially towards the mixer outlet.

8. The apparatus of claim 6, wherein the fuel-air mixer further includes a plurality of non-swirling struts arranged circumferentially about the axis and extending radially across the annular outer passage.

9. The apparatus of claim 6, wherein the air swirler is an inner air swirler, and the fuel-air mixer further includes an outer air swirler disposed with the annular outer passage.

10. The apparatus of claim 1, wherein the center body forms an inner peripheral boundary of the annular inner passage.

11. The apparatus of claim 1, wherein a cross-sectional area of the air inlet is greater than a cross-sectional area of each of the plurality of air outlets; and the cross-sectional area of the air inlet is less than a total cross-sectional area of the plurality of air outlets.

12. The apparatus of claim 1, wherein the internal cavity includes a cavity upstream section and a cavity downstream section between the cavity upstream section and the plurality of air outlets; and the cavity downstream section radially expands as the internal cavity extends axially within the center body towards the plurality of air outlets.

13. The apparatus of claim 1, further comprising:

an annular combustor bulkhead extending circumferentially around an axial centerline;

the fuel-air mixer being one of a plurality of fuel-air mixers mounted to the annular combustor bulkhead, and a first of the plurality of fuel-air mixers located radially outboard of a second of the plurality of fuel-air mixers.

14. The apparatus of claim 13, wherein the first of the plurality of fuel-air mixers is circumferentially aligned with the second of the plurality of fuel-air mixers.

15. The apparatus of claim 1, further comprising:

a pilot fuel injector;

the fuel-air mixer being one of a plurality of fuel-air mixers arranged in an array symmetrically about the pilot fuel injector.

16. The apparatus of claim 1, further comprising:

a pilot fuel injector;

the fuel-air mixer being one of a plurality of fuel-air mixers arranged in an array asymmetrically about the pilot fuel injector.

17. The apparatus of claim 1, wherein the annular fuel passage includes an upstream section, a downstream section and an intermediate section;

the upstream section includes a first cross-sectional area;

the downstream section includes a second cross-sectional area that is different than the first cross-sectional area; and the first cross-sectional area tapers to the second cross-sectional area at the intermediate section.

18. An apparatus for a turbine engine, comprising:

a fuel-air mixer including an annular intermediate passage, an annular inner passage, an annular outer passage and an annular fuel passage, the annular fuel passage formed within a fuel injector body;

the annular inner passage extending axially along an axis within the fuel-air mixer to the annular intermediate passage, the annular inner passage diverging radially outward away from the axis as the annular inner passage extends axially to the annular intermediate passage;

the annular outer passage extending axially along the axis within the fuel-air mixer to the annular intermediate passage, the annular outer passage circumscribing the annular inner passage and the annular fuel passage, and a centerline of the annular outer passage converging radially inward towards the axis as the annular outer passage extends axially from an annular inlet orifice to the annular intermediate passage; and the annular fuel passage radially between the annular inner passage and the annular outer passage, the annular fuel passage circumscribing the annular inner passage, the annular fuel passage extending axially along the axis within the fuel-air mixer to an annular outlet from the annular fuel passage into the annular inner passage, and a centerline of the annular outlet arranged parallel with the axis along an axial length of the annular outlet wherein a radially inner side of the fuel injector body forms a radial outer periphery of the annular inner passage and a radial outer side of the fuel injector body forms a radial inner periphery of the annular outer passage so that the fuel injector body forms an annular splitter for directing compressed air into the inner passage and the outer passage.

19. An apparatus for a turbine engine, comprising:

a fuel-air mixer including a mixer outlet, an annular inner passage, an annular fuel passage and a resonator;

the annular inner passage extending axially along an axis within the fuel-air mixer and circumscribing the resonator, the annular inner passage including an inner passage downstream section and an inner passage upstream section fluidly coupled with the mixer outlet through the inner passage downstream section, and the inner passage downstream section diverging radially outward away from the axis as the annular inner passage extends axially towards the mixer outlet;

the annular fuel passage circumscribing the annular inner passage and extending axially within the fuel-air mixer to the inner passage downstream section; and the resonator forming an inner peripheral boundary of the annular inner passage, the resonator including an air inlet, a plurality of air outlets and an internal cavity fluidly coupled with and between the air inlet and the plurality of air outlets, the internal cavity fluidly coupled with the mixer outlet through the plurality of air outlets, and the internal cavity extending within the axis.

* * * * *